US005184698A

United States Patent [19]

Coffenberry

[11] Patent Number: 5,184,698

[45] Date of Patent: Feb. 9, 1993

[54] EXPANDABLE PLUG

[75] Inventor: Norman D. Coffenberry, Florence, Ky.

[73] Assignee: SDI Operating Partners, L.P.

[21] Appl. No.: 719,143

[22] Filed: Jun. 21, 1991

[51] Int. Cl.[5] ..... F16N 33/00

[52] U.S. Cl. ..... 184/1.5; 4/295; 220/235; 411/34; 411/55; 411/435

[58] Field of Search ..... 411/34, 55, 435; 220/233, 234, 235, 237; 184/1.5, 105.3; 4/295; 138/89; 123/196 R

[56] References Cited

U.S. PATENT DOCUMENTS

| | | | |
|---|---|---|---|
| 402,600 | 5/1889 | Kemp | 220/235 |
| 922,544 | 5/1909 | Turner et al. | 138/90 |
| 987,145 | 3/1919 | Leisinger | 138/89 |
| 1,369,882 | 3/1921 | Brown | 220/235 |
| 2,155,491 | 4/1939 | Jacobs | 220/235 |
| 2,245,887 | 6/1941 | Wikander | 4/295 |
| 2,421,015 | 5/1947 | Davidson | 220/233 |
| 2,493,452 | 1/1950 | Grigg | 285/189 |
| 2,566,816 | 9/1951 | Work | 220/235 |
| 2,905,355 | 9/1959 | Orser | 220/235 |
| 2,978,138 | 4/1961 | Moeller | 220/235 |
| 3,017,800 | 1/1962 | Cohen | 411/34 |
| 3,021,927 | 2/1962 | McKee, Jr. | 411/34 |
| 3,307,731 | 3/1965 | Seltzer | 220/236 |
| 3,365,093 | 1/1968 | Malenke | 411/368 |
| 3,443,716 | 5/1969 | Evans | 220/235 |
| 3,489,312 | 1/1970 | Hunckler | 411/34 |
| 3,604,591 | 9/1971 | Seltzer | 220/284 |
| 3,747,541 | 7/1973 | Reese | 220/235 |
| 3,812,810 | 5/1974 | Moeller | 220/235 |
| 4,434,736 | 3/1984 | Szostak et al. | 411/435 |
| 4,683,597 | 8/1987 | Taylor, Jr. et al. | 4/295 |
| 4,759,462 | 7/1988 | Neglio | 220/235 |
| 5,035,265 | 7/1991 | Chen | 138/89 |
| 5,044,403 | 9/1991 | Chen | 220/237 |

FOREIGN PATENT DOCUMENTS

| | | | |
|---|---|---|---|
| 0478746 | 3/1953 | Italy | 411/34 |
| 0170561 | 3/1960 | Sweden | 220/235 |
| 0161797 | 8/1933 | Switzerland | 220/235 |

*Primary Examiner*—Ira S. Lazarus
*Assistant Examiner*—Alan B. Cariaso
*Attorney, Agent, or Firm*—Wood, Herron & Evans

[57] ABSTRACT

An expandable plug particularly adapted to plug an engine's oil pan drain hole. The expandable plug includes a threaded bolt, a compression plate assembled with the bolt, and a compression nut assembled with the bolt and adapted to bear against the compression plate. A resiliently deformable section of tubing is assembled in slip fit relation with the bolt, the tubing section being axially compressible and radially deformable but not being a specially molded part. With the plug located within the pan's drain hole, tightening of the compression nut causes the tubing section to bulge outwardly into a liquid sealing with the hole, and also to bulge inwardly into liquid sealing relation with the bolt, thereby plugging the drain hole against oil flow therethrough.

2 Claims, 2 Drawing Sheets

EXPANDABLE PLUG

This invention relates to expandable plugs. More particularly, this invention relates to expandable plugs of the type especially adapted for use in plugging threaded throughbores where the threads have been stripped.

An automobile's internal combustion engine makes use of an oil pan to act as an oil sump. When the engine oil needs to be changed, a threaded plug in the oil pan is removed so the engine oil can be drained. And of course before the engine block is re-filled with oil, the plug is re-inserted into sealing relation with the oil pan. Now over repeated uses, it is often the case that the plug's threads, and/or the drain hole threads of the oil pan, become stripped. When this occurs, an oil leak is the result. And oil leaks are undesirable from the engine owner's standpoint.

Expandable plugs are well known to the prior art. In the oil pan environment described above, it is known to the prior art to use an expandable plug for sealing the oil pan drain hole when the threads on the drain plug and/or the pan's drain hole become stripped. And one of the basic components of any such expandable plug is a resiliently deformable part which, through exertion of pressure on same, is forced to expand into sealing relation with the drain hole's periphery when assembled with the oil pan. Typical of such expandable plugs which are adapted for use with oil pans are those shown in Malenke U.S. Pat. No. 3,365,093 and Hunckler et al U.S. Pat. No. 3,489,312.

Each prior art expandable plug, including those cited above, makes use of a resiliently deformable component part that is specially molded of a complex geometric configuration relative to the plug's other component parts in order to allow the plug to carry out its expand function. Accordingly, one problem with prior art expandable plugs is the specially molded resiliently deformable component part (which, as noted, is of a complex geometric configuration) materially increases the cost of the expandable plug relative to an expandable plug that would not require such a specially molded resiliently deformable, complex configured component part. Another problem with prior art expandable plugs used with oil pans is that they tend to loosen in the drain holes, and thereby release the oil seal, when the oil pans are vibrated strongly and/or over a long period of time. This is particularly the case with expandable plugs adapted to be used in an automotive environment, e.g., automobile oil pans. It is necessary, of course, that an oil pan drain plug not vibrate loose from the oil pan during prolonged use because of the undesirable loss of oil that would otherwise occur.

Accordingly, it has been one objective of this invention to provide an improved expandable plug for plugging a throughbore in a workpiece, e.g., a drain hole in an oil pan, that simply makes use of a section of resiliently deformable tubing as the resiliently deformable plug section, thereby eliminating the necessity of providing a specially molded, complex configured deformable part for the expandable plug.

It has been another objective of this invention to provide an improved expandable plug for plugging a throughbore in a workpiece, e.g., a drain hole in an oil pan, against liquid flow therethrough where the plug assembly includes an interference fit between a compression nut and another component part of the plug in order to prevent loosening of the compression nut after a sealing relation has been achieved with the workpiece's throughbore.

In accord with these objectives, the improved expandable plug of this invention is particularly adapted to plug an engine's oil pan drain hole. The expandable plug includes a threaded bolt, a compression plate assembled with the bolt, and a compression nut assembled with the bolt and adapted to bear against the compression plate. A resiliently deformable section of tubing is assembled in slip fit relation with the bolt, the tubing section being axially compressible and radially deformable but not being a complex molded part. With the plug located within the pan's drain hole, tightening of the compression nut causes the tubing section to bulge outwardly into liquid sealing with the hole, and also to bulge inwardly into liquid sealing relation with the bolt, thereby plugging the drain hole against oil flow therethrough.

Other objectives and advantages will be more apparent from the following detailed description taken in conjunction with the drawings in which.

Figure 3:
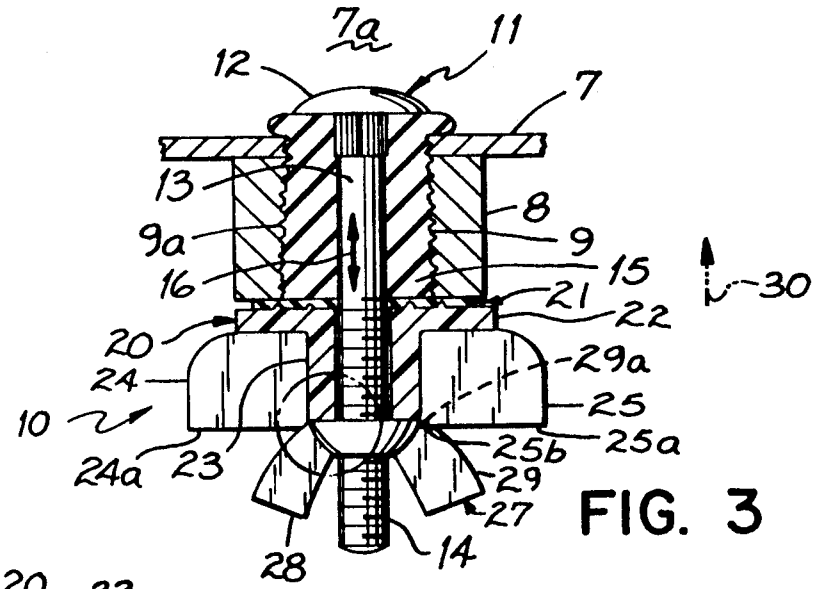
FIG. 3 is a view similar to FIG. 1 but illustrating the expandable plug in assembly with a oil pan's drain hole, and in plugging relation therewith.

The expandable plug 10 of this invention is particularly adapted for use with a workpiece in the form of an oil pan 7 (not shown in its entirety) such as is commonly used in combination with an internal combustion engine (not shown). That section of the oil pan 7 illustrated in FIG. 3 includes the pan itself and a plug nut 8 fixed to the outside surface of the pan. Note this workpiece structure presents the oil pan 7 with a throughbore in the form of drain hole 9 that is internally threaded, and within which an ordinary threaded drain plug (not shown) had been previously used. But when the threads become stripped in the drain hole 9 as shown at 9*a*, and/or on the threaded drain plug (not shown), the expandable plug 10 of this invention can be used to plug that oil pan's drain hole against oil flow therethrough from interiorly 7*a* of the pan.

Figure 1:
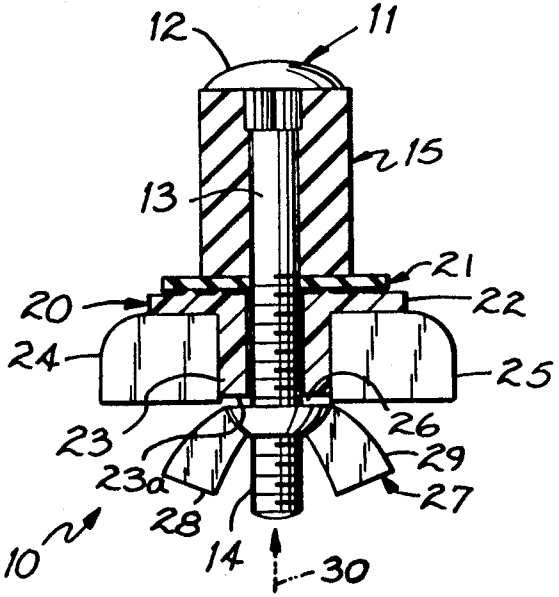
FIG. 1 is a cross sectional view of an expandable plug in accord with the principles of this invention, same being illustrated in the assembled and non-expanded position.
Figure 2:
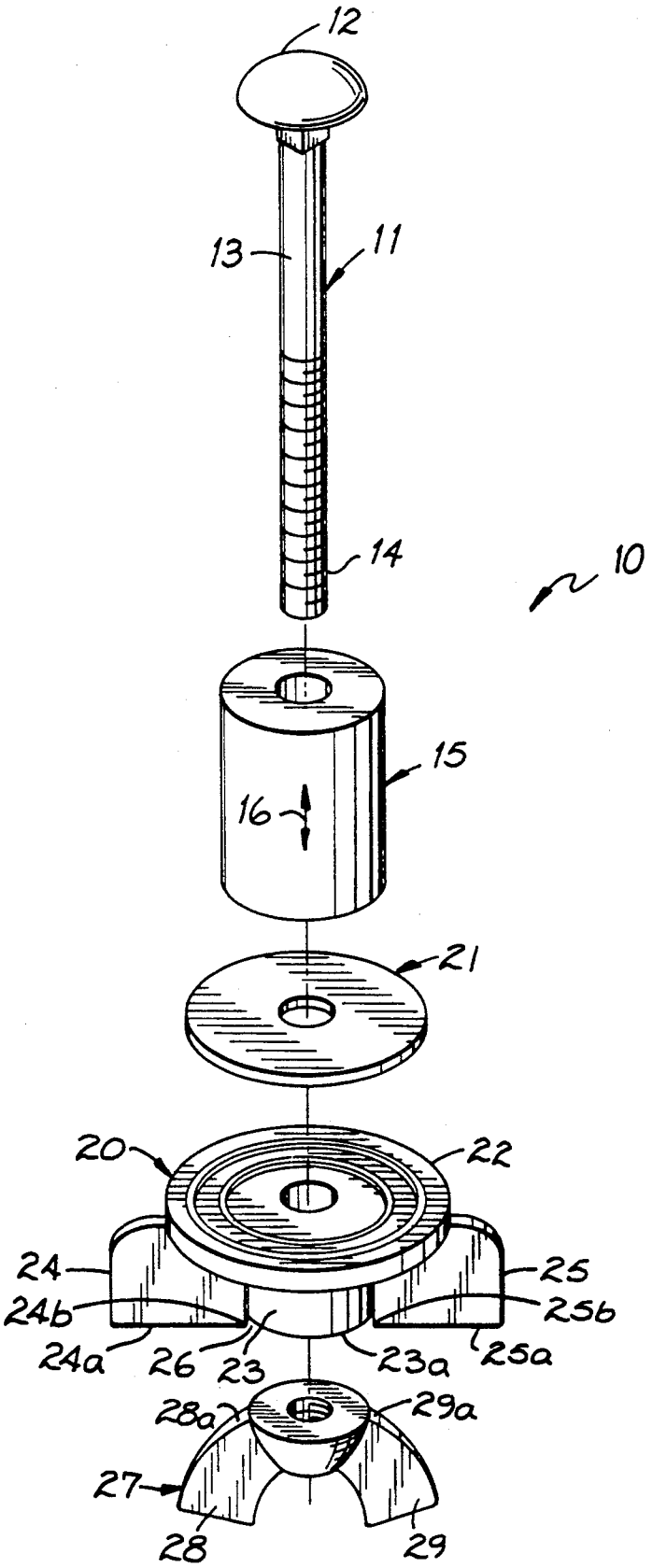
FIG. 2 is an exploded perspective view of the component parts used in the expandable plug illustrated in FIG. 1.

An expandable plug 10 in accord with the principles of this invention is particularly illustrated in FIGS. 1 and 2. The expandable plug 10 includes a threaded bolt 11 having a head 12 at one end of the bolt's shaft 13, that shaft being threaded at the other end as at 14. A resiliently deformable section 15 of tubing is assembled in slip fit relation with the bolt, see FIG. 1. This tubing section 15 is axially compressible relative to the assembly's longitudinal axis 16, and is radially expandable and radially compressible relative to its longitudinal axis. Note particularly the tubing section 15 is of a length at least about equal to the length of the drain hole 9 with which the expandable plug 10 is to be used, see FIG. 3. Note also that, when relaxed or not compressed, the internal diameter of the tubing section 15 is no less than the external diameter of the bolt's shaft 13 so the tubing section simply can be slip fit onto that bolt, see FIG. 1. Note also the bolt head 12 and the tubing section 15 are each of an external diameter such that same can extend through the drain hole 9 before the expandable plug 10 is expanded into assembly with the oil pan 7. And further, the outside diameter of the bolt head 12 is only slightly less than the inside diameter of the oil pan's drain hole 9, and the outside diameter of the tubing section 15 is not substantially greater than the outside diameter of the bolt head. It is important to note here that the tubing section 15 is simply a section of preformed flexible hose or tubing, and the flexible tubing section can be easily cut to length from an endless length of that tubing. This, of course, eliminates the need for a specially formed, complex configured, molded compressible/expandable component part as the sealing element in the expandable plug 10 of this invention.

A compression plate 20 is assembled with the threaded bolt 11 with preferably a flexible washer 21 interposed on the bolt between the compression plate and the tubing section 15. The compression plate 20 includes a compression ring 22 and a compression collar 23 co-axially fixed to the compression ring. A pair of handles 24, 25 are fixed to the compression plate 20, the handles being in the form of wings molded integral with the compression ring and compression collar, and being radially oriented relative to the compression plate. These handles or wings 24, 25 allow the expandable plug 10 to be held manually in the desired orientation relative to the oil pan's drain hole 9 when assembling the expandable plug with that drain hole. Note also the end radial edges 24*a*, 25*a* of the wings 24, 25 are in a traverse plane (relative to the plug's longitudinal axis 16) that is located beyond the end edge 23*a* of the compression collar 23, thereby defining a notch 26 at that end of the compression plate 20 which cooperates with a compression nut 27 as explained further below.

The compression nut 27 (which, as illustrated, is a wing nut) is assembled with the bolt 11, and is adapted to bear against the compression plate 20. More specifically, the compression nut 27 is threaded onto the bolt's threaded section 14, and is adapted to bear against end 23*a* of the compression plate's collar 23. When the expandable plug 10 is oriented within the oil pan's drain hole 9, tightening of the compression nut 27 on the bolt 11 causes the tubing section 15 to bulge outwardly relative to the bolt into oil sealing relation with the pan's drain hole 9, and also to bulge inwardly relative to the bolt into oil sealing relation with the bolt, thereby plugging the pan's drain hole against oil flow therethrough.

Figure 3A:
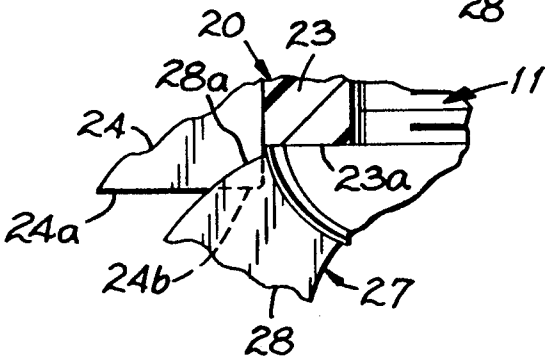
FIG. 3A is a enlarged perspective view of the encircled area shown in FIG. 3.

Importantly relative to this invention, the expandable plug 10 also includes interference structure partially carried by the compression plate 20 and partially carried by the compression nut 27. That interference structure functions to prevent loosening of the wing nut 27 on the bolt 11 after the sealing relationship (shown in FIG. 3) has been achieved such as might otherwise occur in response to vibration of the assembled plug and oil pan 7. The interference structure is comprised of inner corner sections 24*b*, 25*b*, carried by the compression plate's wings 24, 25 due to the fact those wings are of an axial length greater than the compression collar 23, i.e., due to the existence of notch 26 on the compression plate 20. These interference corners 24*b*, 25*b* cooperate with the wing nut's wings 28, 29, as at 28*a*, 29*a*, to prevent rotation of the wing nut 27 after the expandable plug has been installed within the oil pan's drain hole, see FIG. 3A.

In use of the expandable plug 10 of this invention, and when same is used with an oil pan's drain hole 9, the expandable plug is initially in the collapsed or non-expanded configuration shown in FIG. 1 (such as will be the case when all of the tubing section 15, washer 21, and compression plate 20 are loosely carried on, i.e., axially slideable relative to, the bolt's shaft 13). In this initial installation configuration, and as earlier noted, the outside diameter of the bolt's head 12 and the outside diameter of the tubing section 15 are such as to allow those components to be inserted through the drain hole 9 defined by the oil pan's plug nut 8 and oil pan section 7. Note also that, in the collapsed or non-expanded attitude, the tubing section 15 and bolt shaft 13 are of such length that same are longer than the drain hole's length. This allows the expandable plug 10 to be installed into the drain hole 9 in the direction shown by phantom arrow 30 from outside the oil pan 7 until the plug's washer 21 seats against the oil's pan plug nut 8.

In this initial seated attitude, and thereafter, the plug's wing nut 27 is tightened manually on the bolt's shaft 13. This causes the compression plate 20 to bear against the tubing section 15, thereby forcing that tubing section to compress axially which, in turn, causes that tubing section to expand radially both outwardly and inwardly relative to the bolt's shaft 13. As the tubing section 15 bulges outwardly relative to the bolt's shaft 13, same provides an oil sealing relation with the drain hole which constricts further outward bulging, and as the tubing section bulges inwardly relative to the bolt's shaft same provides an oil sealing relation with the bolt itself, thereby plugging the oil pan's drain hole against oil flow therethrough. When the wing nut 27 has been tightened against the compression collar to that extent where the tubing section 15 has sealingly engaged both the oil pan's drain hole 9 and the plug's bolt 13, the wing nut's wings 28, 29 will be located in an interference fit relation with the compression plate's wings 24, 25 as shown in the enlarged area in FIG. 3A. And this interference relation between the wing nut's wings 28, 29 and the compression plate's wings 24, 25 will function to prevent loosening of the compression nut 27 on the bolt 13 after the sealing relationship with drain hole 9 has been achieved such as might otherwise might occur in response to vibration of the assembled plug 10 and oil pan 7.

Having described in detail the preferred embodiment of my invention, what I desire to claim and perfect by Letters Patent is:

1. An expandable plug for plugging a throughbore in a workpiece against liquid flow therethrough, said plug comprising a threaded bolt having a head at one end, a resiliently deformable section of tubing assembled in slip-fit relation with said bolt, said tubing section being of cylindrical internal and cylindrical external configuration, said tubing section being open at both ends thereof with one end of said tubing section being seated against said bolt head, said tubing section being axially compressible and radially expandable, said tubing section having a length at least about equal to the length of said throughbore, and said bolt head and said tubing section being sized to extend through said throughbore before said plug is assembled with said workpiece, a compression plate assembled with said bolt, said tubing section being positioned on said bolt between said bolt head and said compression plate, said compression plate comprising a compression ring, a compression collar coaxial and integral with said compression ring, and a pair of handle wings integral with said compression ring and said compression collar, a compression nut assembled with said bolt and adapted to bear against said compression collar, said compression nut including a pair of wings, tightening of said compression nut on said bolt causing said tubing section to bulge outwardly relative to said bolt into liquid sealing relation with said throughbore, and also to bulge inwardly relative to said bolt into liquid sealing relation with said bolt, thereby plugging said throughbore against liquid flow therethrough, and interference structure partially carried by said compression plate and partially carried by said compression nut, said interference structure comprising a pair of notches defined by said compression collar and respective handle wings, said notches sized to receive said compression nut as said nut bears against said compression plate, said handle wings presenting interference corners adjacent said notches which engage said wings of said compression nut when said nut is tightened on said bolt, said interference structure functioning to prevent loosening of said compression nut on said bolt after said sealing relationship has been achieved such as might otherwise occur in response to vibration of the assembled plug and workpiece.

2. An expandable plug as claimed in claim 1, said workpiece comprising an oil pan, and a plug nut fixed to said oil pan in co-axial relation with said throughbore, said bolt head being located interiorly of said oil pan when said plug is assembled with said oil pan.

* * * * *